United States Patent [19]

Maruyama et al.

[11] 4,382,167

[45] May 3, 1983

[54] PUSH-BUTTON SWITCH

[75] Inventors: Takeshige Maruyama; Sadayoshi Iwasaki, both of Furukawa, Japan

[73] Assignee: Alps Electric Co., Ltd., Tokyo, Japan

[21] Appl. No.: 244,051

[22] Filed: Mar. 16, 1981

[30] Foreign Application Priority Data

Mar. 14, 1980 [JP] Japan ..... 55-33163[U]
Mar. 14, 1980 [JP] Japan ..... 55-33168[U]

[51] Int. Cl.[3] ..... H01H 13/56

[52] U.S. Cl. ..... 200/153 J; 200/303; 200/328

[58] Field of Search ..... 200/153 J, 159 R, 293, 200/303, 328

[56] References Cited

U.S. PATENT DOCUMENTS 2,284,644 6/1942 Dubilier ..... 200/303
3,704,353 11/1972 Halla ..... 200/159 R
3,732,386 5/1973 Ohikita ..... 200/153 J
4,218,598 8/1980 Iwasaki et al. ..... 200/153 J

FOREIGN PATENT DOCUMENTS 1233456 2/1967 Fed. Rep. of Germany ... 200/153 J
2618572 11/1977 Fed. Rep. of Germany ... 200/159 R

*Primary Examiner*—John W. Shepperd
*Attorney, Agent, or Firm*—Guy W. Shoup; Gerard F. Dunne

[57] ABSTRACT

A push-button switch comprises a cover member which is made from a synthetic resin, a switch case in which a plurality of fixed terminals are embedded by the unitary molding, and a slide member which receives movable contact pieces therein. Side walls of the switch case have thick-walled base portions and thin-walled upper edge portions, and the cover member is sandwiched between the pair of thin-walled upper edge portions so as to make the pair of opposing side walls parallel.

15 Claims, 6 Drawing Figures

PUSH-BUTTON SWITCH

BACKGROUND OF THE INVENTION

The present invention relates to a push-button switch.

In a prior-art switch, a base plate formed from a phenol-resin lamination or the like has holes formed by punching for receiving terminals, and fixed terminals are inserted in these holes and then fixed by caulking. With this structure, when the automatic soldering is performed to connect the terminals in a circuit, a flux from the solder sometimes spreads along the fixed terminal and flows into the switch through a gap between the terminal and its hole in the base plate. Such gaps are, therefore, often filled to prevent penetration of the flux by a coating of a binder. However, coating with binder is very laborious. For this reason, it is recent practice to fabricate a switch case by molding a synthetic resin and embedding the fixed terminals during the molding process. In general, however, when a box-shaped switch case is made by plastic molding, the upper edges on the open side may bend inwards to some extent, and this inevitably leads to serious problems. It is also the present state of the art that a very high precision cannot always be expected in molding a synthetic resin. With such switch case made by plastic molding, the presence of the aforecited deformation sometimes leads to the disadvantage that a slide member cannot be inserted into the switch case or that the movement of the slide member is not smooth. Conversely, when a dimensional allowance is made great, the play of the slide member increases, which can result in the disadvantage that the switch does not execute a smooth operation in the changes of state of the switch.

In assembling a push-button switch which employs a heart-shaped cam groove to contact operation, a lock pin needs to be accurately positioned in the heart-shaped cam groove and to be normally urged therein by a leaf spring or the like. In addition, since respective components are often small, the assemblage must inevitably be performed by hand. These become serious problems in permitting assemblage of the switch by automation.

SUMMARY OF THE INVENTION

It is therefore an object of the present invention to provide a push-button switch which is suited to assemblage by automation.

Another object of the present invention is to provide a push-button switch in which a solder flux will not penetrate the switch case during automatic soldering.

Still another object of the present invention is to provide a push-button switch in which a slide member may be movable smoothly even when the switch case has a row of fixed terminals embedded therein during molding.

A further object of the present invention is to provide a push-button switch wherein a spring and a guide pin constituting the heart cam mechanism can be assembled readily and which permits assembly by automation.

In order to accomplish these objects, according to the present invention, the upper side of a switch case in which a row of fixed terminals is embedded by molding is made open, and outer walls of a cover case are forcibly fitted on inner walls of the opening, whereby the deformation of the switch case attributable to the unitary molding, that is, the inward bend of upper edges on the open side is, corrected after assemblage. Other objects and advantages of the present invention will become apparent from the following detailed description taken with reference to the accompanying drawings.

PREFERRED EMBODIMENT OF THE INVENTION

Figure 4:
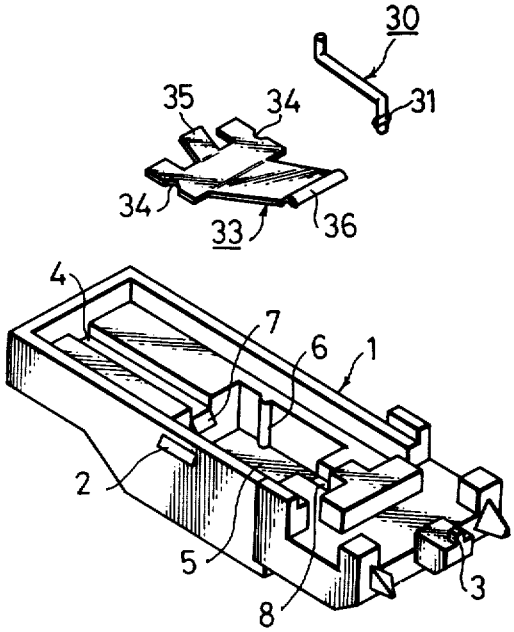
FIG. 4 is an exploded, perspective view showing a cover member, a lock pin and a leaf spring in the embodiment of the present invention.
Figure 5:
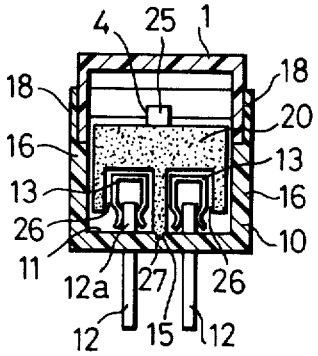
FIG. 5 is a cross-sectional view of the push-button switch of the embodiment of the present invention.
Figure 6:
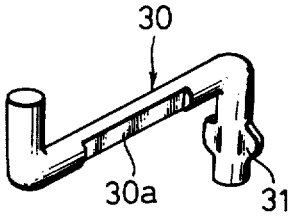
FIG. 6 is a perspective view of an example of the lock pin for use in the push-button switch of the embodiment of the present invention.

Hereunder, an embodiment of the present invention will be described with reference to the drawings. Numeral 1 designates a cover member formed by molding a synthetic resin. The outer side surfaces of the cover member 1 are provided with engaging protuberances 2 which are triangular in section, and the front end thereof is provided with a projection 3 which can be inserted into a guide groove of a slide member as will be described later. As best shown in FIG. 4, a slot 4 in which a guide bulge of the slide member may slide is provided inside the cover member 1. A deep recess 5 provides a portion for receiving a leaf spring to be described later. Lugs 6 are formed at positions of the surrounding walls of the recess 5 which oppose each other. A protuberance 7 of triangular section is formed on another surrounding wall. A hole 8 penetrating through the cover member 1 is provided at that position outside the recess 5 which opposes the protuberance 7. Numeral 10 indicates a switch case which is made from a synthetic resin and in which fixed terminals are embedded by unitary molding. The switch case 10 is substantially box-shaped. The plurality of fixed terminals 12 . . . are embedded in a bottom plate portion 11 by unitary molding. A guide rail 14 for guiding a movable contact piece 13 is formed as an extension of each row of fixed terminals 12. A long guide slot 15 is formed in the central part of the bottom plate. A pair of opposing side walls 16 consist of thick-walled base parts 17 and thin-walled upper parts 18. The upper parts 18 are provided with slits 19 for engaging the engaging protuberances 2 of the cover member 1, and extend inwardly at a slight angle from the perpendicular. Numeral 20 indicates the slide member molded from a synthetic resin. The slide member 20 includes an operating portion 21 and a flange portion 22. A heart-shaped cam groove 23, a guide groove 24 and a guide bulge 25 are formed on the upper side, while portions 26 for receiving the movable contact pieces 13 and a protrusive rib 27 to be inserted into the guide slot 15 of the switch case 10 are provided on the lower side. The movable contact pieces 13 are formed by pressing and bending a phosphor bronze plate whose one surface is plated with silver. The movable contact pieces 13 lie within respective receiving portions 26 of the slide member 20, and slide on contact portions 12*a* of a respective row of fixed termainals 12. Numeral 30 indicates a lock pin which is fabricated by bending a metal wire rod twice and one end of which is formed with a broadened engaging portion 31 by crushing. The leaf spring 33 referred to before is fabricated by punching and bending a resilient metal plate. The leaf spring 33 is provided with notches 34 in opposing portions of its side edges. A tongue 35 bent downwardly at an angle of about 45 degrees, and a long arm portion 36 for pressing the lock pin 30 are formed along the longitudinal direction of the leaf spring 33. Shown at numeral 37 is a coiled spring for urging the slide member 20 unidirectionally. As best shown in FIG. 6, flat portions 30*a* and 30*a* parallel to each other (only one is seen) are formed on opposite sides in substantially the middle part of the lock pin 30. Especially in the assemblage by automation, the flat portions allow the machine to readily grasp the lock pin and facilitate setting the directions in which the lock pin is assembled.

Now, the assemblage of the push-button switch of the present invention will be described. First, the leaf spring 33 is inserted into the deep recess 5 of the cover member 1 in the state in which the notches 34 are held in engagement with respective lugs 6. Then, the tongue 35 of the leaf spring 33 is urged downwardly along the inclined surface of the protuberance 7. When the tongue 35 has cleared the inclined surface of the protuberance 7, the leaf spring 33 reaches the bottom of the recess 5 as viewed in FIG. 4, the tongue 35 is stopped in engagement with the protuberance 7 and the leaf spring 33 is held in the cover member 1. Subsequently, one end of the lock pin 30 provided with the engaging portion 31 is forcibly fitted into the hole 8, and the arm portion 36 of the leaf spring 33 is caused to abut on the lock pin 30. Thus, a cover portion is provided with the cover member 1, the leaf spring 33 and the lock pin 30 assembled thereto. All the assembling operations can be completed by inserting the components into the cover member 1 in only one direction to enable assembly by automatic techniques.

At the next step, the movable contact pieces 13 are placed the receiving portions 26 of the slide member 20. The resetting coiled spring 37 is inserted from the side of the guide bulge 25 of the slide member 20, and it is compressed onto the side of the flange 22. Under this state, the slide member 20 is slid and inserted from the open front side of the switch case 10 until the movable contact pieces 13 sandwich the contact portions 12*a* of the respective fixed terminals 12.

Figure 1:
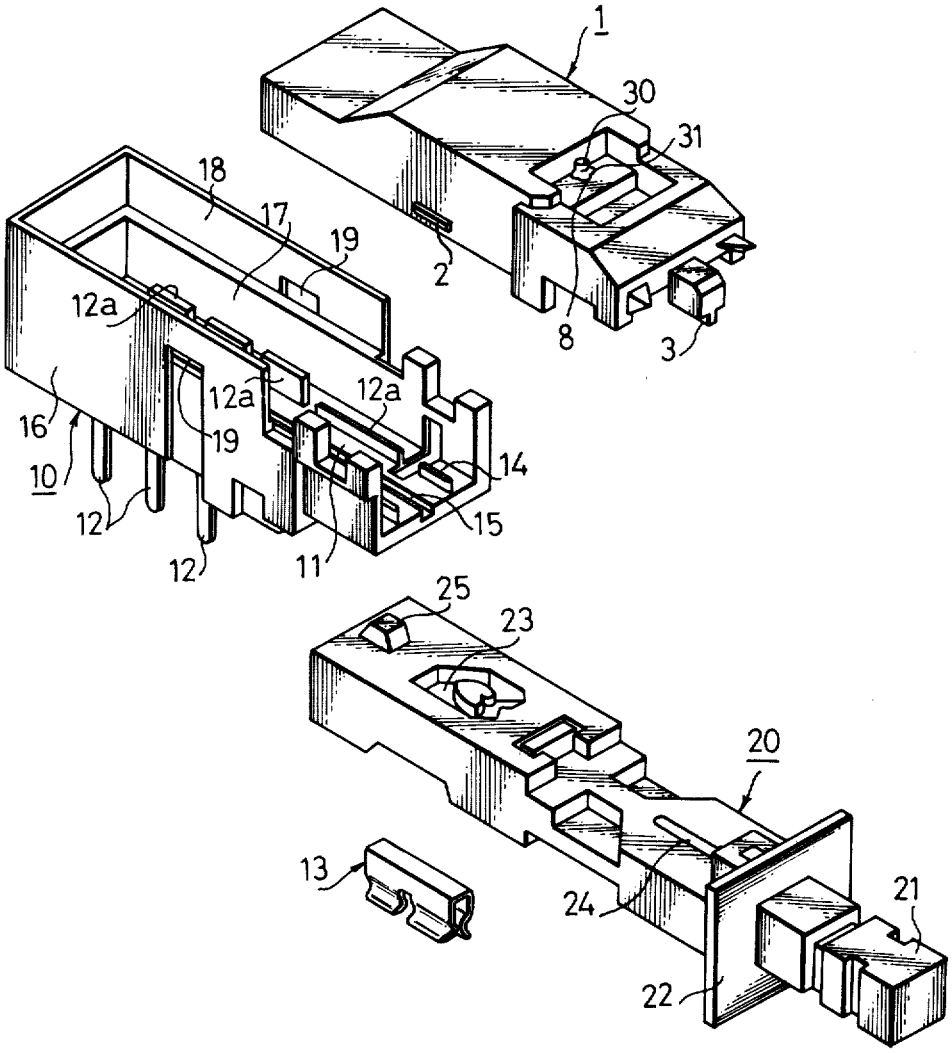
FIG. 1 is an exploded, perspective view of a push-button switch embodying the present invention.
Figure 2:
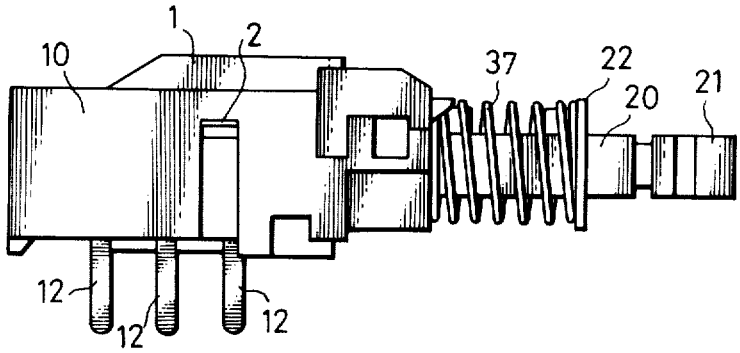
FIG. 2 is a side view of the push-button switch of the embodiment of the present invention after having been assembled.
Figure 3:
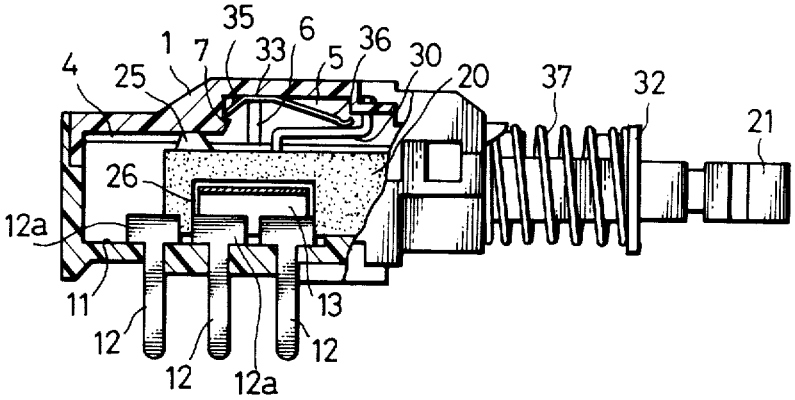
FIG. 3 is a view, partly in section, of the switch shown in FIG. 2.

Subsequently, the cover portion described above is inserted from the upper open part of the switch case 10 so that the cover member 1 may be fit between the pair of thin-walled upper edges 18 and 18. The insertion is further continued to bring the engaging protuberances 2 of the cover member 1 into engagement with the slits 19 in the side walls 16 of the switch case 10, whereby the cover member 1 and the switch case 10 are attached. At this time, the end of the lock pin 30 other than the broadened end 31 lies in the heart-shaped cam groove 23 of the slide member 20 and is urged thereinto under the action of the leaf spring 33 (refer to FIG. 3). Thereafter, when the resetting coiled spring 37 having been in the compressed state is released, the slide member 20 is moved by the returning force of the coiled spring 37 in the direction outward from the switch case 10. However, the projection 3 of the cover member 1 lies in the guide groove 24 of the slide member 20 and functions as a stopper when it has moved to the rear end of the guide groove 24, so that the slide member 20 does not come out from the switch case 10. This state is the unpressed state of the push-button switch of the present invention (refer to FIG. 3).

Now, the operation of the push-button switch of the present invention will be briefly described. When the operating portion 21 of the slide member 20 is pressed from the unpressed state illustrated in FIG. 3, the slide member 20 moves against the force of the coiled spring 37. Then, the movable contact pieces 13 move along the conductive fixed-terminals to change the state of the switch. Simultaneously, the lock pin 30 moves within the heart-shaped cam groove 23, and upon releasing the slide member 20, the slide member 20 is locked in its inner position by the function of the lock pin 30. Thereafter, when the operating portion 21 of the slide member 20 is pressed once more, the lock pin 30 moves into the unlocked state. When the operating portion is released, the slide member 20 returns to the original position of the unpressed state owing to the returning force of the coiled spring 37. At this time, the movable contact pieces 13 are also moved to change the state of the switch.

The present invention is not restricted to the foregoing embodiment, but various alterations in design may be made within a scope not departing from the appended claims.

What is claimed is:

1. A push-button switch comprising:

a switch case formed with respective openings on an upper side and one end side thereof and having a plurality of rows of fixed terminal embedded on a lower side thereof;

a slide member slidably inserted into said switch case from said opening on said one end side of said switch case, said slide member being formed on an upper side thereof with a heart-shaped cam groove, on a lower side thereof with receiving portions for receiving movable contact pieces adapted to slide in contact with the fixed terminals and at a front end part thereof with an operation portion for operating said slide member against a coil spring;

a cover member being received within said opening on said upper side of said switch case for closing it, said cover member having on a lower side thereof means for holding a Z-shaped lock pin in slidable enegagement with said heart-shaped cam groove, a recess adjacent to said holding means for receiving a spring member for pressing said lock pin against said heart-shaped cam groove; and coacting engaging means formed respectively on the side walls of said switch case and side walls of said cover member for holding the two together;

wherein one inner wall of said cover member surrounding said recess and being orthogonal to the sliding direction of said slide member is provided with a protuberance for holding said spring member, said spring member being flat and provided with an engaging piece for engaging with said protuberance.

2. A push-button switch according to claim 1, wherein two opposing inner walls of said cover member surrounding said recess and extending in the sliding direction of said slide member are respectively provided with guide lugs for guiding said spring member, and said spring member being formed with notches which are guided by said lugs.

3. A push-button switch according to claim 1, wherein lower parts of said side walls of said switch case are formed relatively thick, while upper parts close to the upper side opening are formed relatively thin.

4. A push-button switch according to claim 3, wherein said side walls of said switch case extend inward resiliently at a slight angle so as to angle closer to each other.

5. A push-button switch according to claim 4, wherein said cover member is mounted on said switch case in a manner to spread the thin-walled side walls of said switch case against the resilience thereof, whereby the planes of said side walls become parallel to each other.

6. A push-button switch according to claim 1, wherein an upper surface of said slide member is formed with a guide groove extending in the sliding direction of said member, and a projection formed integrally with said cover member is held in engagement with said guide groove.

7. A push-button switch according to claim 1, wherein the lower side of said slide member is integrally formed with a protrusive rib which is held in slidable engagement with a guide slot formed in a lower inner surface of said switch case.

8. A push-button switch according to claim 1, wherein said engaging means formed in said side walls of said switch case are slits, while the engaging means formed in said cover member are protuberances engageable with said slits.

9. A push-button switch according to claim 1, wherein flat portions parallel to each other are formed in an intermediate part of said lock pin.

10. A push-button switch comprising:

a switch case formed with respective openings on an upper side and one end side thereof and having a plurality of rows of fixed terminal embedded on a lower side thereof;

a slide member slidably inserted into said switch case from said opening on said one end side of said switch case, said slide member being formed on an upper side thereof with a heart-shaped cam groove, on a lower side thereof with receiving portions for receiving movable contact pieces adapted to slide in contact with the fixed terminals and at a front end part thereof with an operation portion for operating said slide member against a coil spring;

a cover member for being received within said opening on said upper side of said switch case for closing it, said cover member having on a lower side thereof means for holding a Z-shaped lock pin in slidable engagement with said heart-shaped cam groove, a recess adjacent to said holding means for receiving a spring member for pressing said lock pin against said heart-shaped cam groove, and coacting engaging means formed respectively on the side walls of said switch case and side walls of said cover member for holding the two together;

wherein lower parts of said side walls of said switch case are formed relatively thick, while upper parts close to the upper side opening are formed relatively thin, said side walls of said switch case extending inward resiliently at a slight angle so as to angle closer to each other.

11. A push-button switch according to claim 10, wherein said cover member is mounted on said switch case in a manner to spread the thin-walled side walls of said switch case against the resilience thereof, whereby the planes of said side walls become parallel to each other.

12. A push-button switch according to claim 10, wherein an upper surface of said slide member is formed with a guide groove extending in the sliding direction of said member, and a projection formed integrally with said cover member is held in engagement with said guide groove.

13. A push-button switch according to claim 10, wherein the lower side of said slide member is integrally formed with a protrusive rib which is held in slidable engagement with a guide slot formed in a lower inner surface of said switch case.

14. A push-button switch according to claim 10, wherein said engaging means formed in said side walls of said switch case are slits, while the engaging means formed in said cover member are protuberances engageable with said slits.

15. A push-button switch according to claim 10, wherein flat portions parallel to each other are formed in an intermediate part of said lock pin.

* * * * *